US005463716A

United States Patent [19]

Taguchi

[11] Patent Number: 5,463,716

[45] Date of Patent: Oct. 31, 1995

[54] FORMANT EXTRACTION ON THE BASIS OF LPC INFORMATION DEVELOPED FOR INDIVIDUAL PARTIAL BANDWIDTHS

[75] Inventor: Tetsu Taguchi, Tokyo, Japan

[73] Assignee: NEC Corporation, Tokyo, Japan

[21] Appl. No.: 185,271

[22] Filed: Jan. 18, 1994

Related U.S. Application Data

[63] Continuation of Ser. No. 892,647, Jun. 2, 1992, abandoned, which is a continuation of Ser. No. 586,312, Sep. 20, 1990, abandoned, which is a continuation of Ser. No. 453,270, Dec. 21, 1989, abandoned, which is a continuation of Ser. No. 867,669, May 28, 1986, abandoned.

[30] Foreign Application Priority Data

| | | | |
|---|---|---|---|
| May 28, 1985 | [JP] | Japan | 60-114525 |
| May 28, 1985 | [JP] | Japan | 60-114526 |
| May 28, 1985 | [JP] | Japan | 60-114527 |

[51] Int. Cl.[6] ..... G10L 9/00

[52] U.S. Cl. ..... 395/2.18; 395/2.14

[58] Field of Search ..... 381/29–51; 395/2.1–2.34

[56] References Cited

U.S. PATENT DOCUMENTS

| | | | |
|---|---|---|---|
| 3,327,058 | 6/1967 | Coker | 381/50 |
| 4,070,709 | 1/1978 | Roberts et al. | 381/41 |
| 4,346,262 | 8/1982 | Willems et al. | 381/50 |
| 4,424,415 | 1/1984 | Lin | 381/50 |
| 4,486,899 | 12/1984 | Fushikida | 381/36 |
| 4,592,085 | 5/1986 | Watari et al. | 381/43 |
| 4,625,286 | 11/1986 | Papamichalis et al. | 364/513.5 |

FOREIGN PATENT DOCUMENTS

| | | |
|---|---|---|
| 62-54298 | 3/1987 | Japan . |
| 62-54299 | 3/1987 | Japan . |
| 62-54300 | 3/1987 | Japan . |

OTHER PUBLICATIONS

Parsons, Thomas W., "Voice and Speech Processing", McGraw–Hill Book Co., 1986, pp. 50–52, 103–105, and 210–219.

Rabiner et al., "Linear Predictive Coding of Speech", pp. 396–455 *Digital Processing of Speech Signals*, Prentice–Hall, 1978.

*Primary Examiner*—Allen R. MacDonald
*Assistant Examiner*—Michelle Doerrler
*Attorney, Agent, or Firm*—Sughrue, Mion, Zinn, Macpeak & Seas

[57] ABSTRACT

A frequency bandwidth of a speech signal is divided into a plurality of partial bandwidths. Formant information is extracted on the basis of LPC information developed for the respective partial bandwidths. At least one partial bandwidth may overlap upon the preceding bandwidth. The boundary frequencies of the partial bandwidths can be determined based on the frequency envelope of the speech signal.

3 Claims, 2 Drawing Sheets

FORMANT EXTRACTION ON THE BASIS OF LPC INFORMATION DEVELOPED FOR INDIVIDUAL PARTIAL BANDWIDTHS

This is a Continuation of application Ser. No. 07/892,647 filed Jun. 2, 1992 now abandoned, which is a continuation of Ser. No. 07/586,312 filed Sep. 20, 1990 now abandoned, which is a continuation of Ser. No. 07/453,270 filed Dec. 21, 1989 now abandoned, which is a continuation of Ser. No. 06/867,669 filed May 28, 1986 now abandoned.

FIELD OF THE INVENTION

The present invention relates to a formant extractor, particularly to a formant extractor of the divided frequency bandwidth-type.

BACKGROUND OF THE INVENTION

Formant information of speech has been used as an effective information for speech analysis, synthesis and recognition systems. A well-known and highly accurate technique for extracting formant information is to solve a high order equation having LPC (Linear Prediction Coding) coefficients as constants using a Newton-Lapson method.

However, there has not been a method for algebraically solving the high order equation, and the solving of the equation by use of a numerical calculation method becomes exponentially difficult with increase in the order of the equation.

Therefore, an object of the present invention is to provide a formant extractor capable of high extraction accuracy.

Another object of the present invention is to provide a formant extractor having high stability.

Another object of the present invention is to provide a formant extractor capable of operating in real time.

Still another object of the present invention is to provide a formant extractor of compact size.

SUMMARY OF THE INVENTION

According to the present invention, a frequency bandwidth of a speech signal is divided into a plurality of bandwidths and formant information is extracted on the basis of LPC information developed for the respective divided bandwidths. At least one subsequent bandwidth may be superimposed upon the preceding bandwidth in part. The boundary frequency of the divided bandwidths can be determined based on the frequency envelope of the speech signal.

PREFERRED EMBODIMENTS OF THE INVENTION

Figure 1:
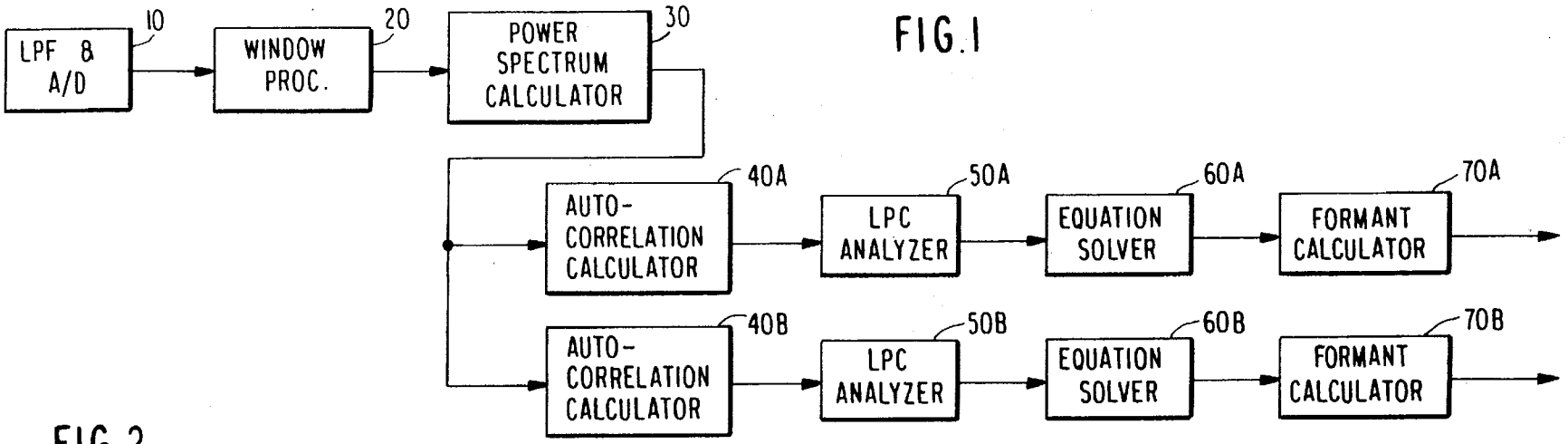
FIG. 1 shows a block diagram of a first embodiment according to the present invention.

FIG. 1 shows a block diagram of an embodiment according to the present invention. The technique of this invention, called "divided frequency bandwidth-type formant extractor", develops formant information on the basis of LPC coefficients obtained through LPC analysis for the respective divided bandwidths. This invention is also capable of reducing remarkably the order of the high order equation corresponding to the number of the divided bandwidths, and extracting formant information with high accuracy in real time domain.

Referring to FIG. 1, an input speech signal is supplied to an A/D converter 10. The A/D converter 10 eliminates frequency components higher than 3.4 kHz by a Low Pass Filter (LPF) equipped therein, and samples at 8kHz and quantizes by 12 bits the signal passed through the LPF.

A window processor 20 temporarily memorizes the quantized signal for a period of 32 msec, i.e., 250 samples, in a memory equipped therein and performs window processing by multiplying a window function such as a Hamming window function for each period of 10 msec.

A power spectrum calculator 30 carries out a Discrete Fourier Transform (DFT) process for the speech signal of 256 samples and develops a power spectrum from the complex spectrum obtained.

Autocorrelation calculators 40A, 40B develop autocorrelation coefficients for the predetermined lower bandwidths and higher bandwidths, respectively, in response to the power spectrum data from the power spectrum calculator 30.

The autocorrelation calculator 40A reads out the power spectrum for the lower bandwidth, for example, of 0.3 kHz~1.3 kHz stored in the power spectrum calculator 30, and performs an Inverse Discrete Fourier Transform (IDFT) process for the power spectrum. The IDFT is carried out with a reference point of 300 Hz so that the phase difference of the cosine coefficient for each frequency component becomes zero. All cosine coefficients for each frequency component are assumed to change with the common original point of 300 Hz. The obtained IDFT result indicates the autocorrelation coefficients, with autocorrelation coefficients up to the sixth order being developed.

On the other hand, the autocorrelation calculator 40B reads out the power spectrum for the higher bandwidth, for example, of 1.3 kHz~3.3 kHz and performs IDFT on the read out data to develop autocorrelation coefficients of the sixth order for the higher bandwidth.

LPC analyzers 50A and 50B respectively extract $\alpha$ parameters of the sixth order for the lower and higher bandwidths in a well-known method manner, e.g., as disclosed in Japanese Laid Open Patents 211797/83 and 220199/83.

Equation solvers 60A and 60B solve the high order equation having $\alpha$ parameters for the lower and higher bandwidths of sixth order as constants, and supplies its result to formant calculators 70A and 70B to determine formant information for the lower and higher bandwidths through the well-known technique disclosed, e.g., in a book entitled *Digital Processing of Speech Signals* by L. R Rabiner and R. W. Schafer, PRENTICE-HALL, p. 442.

According to this embodiment, the bandwidth is divided into two bandwidths. Therefore, in the case of LPC coefficients of twelfth order, formant information is extracted by solving the higher order equation on the basis of LPC coefficients of the sixth order, thereby making it much easier to solve the higher order equation.

Figure 2:
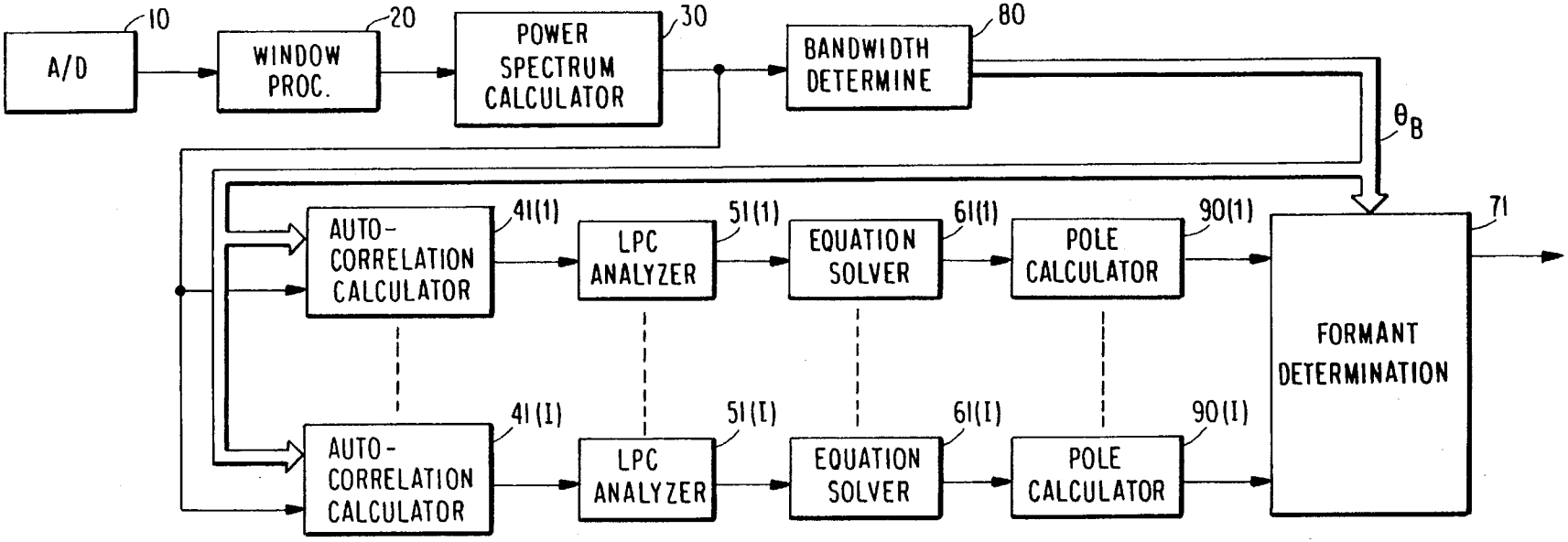
FIG. 2 shows a block diagram of a second embodiment according to the present invention.

FIG. 2 represents a second embodiment of the invention which is a varation of the first embodiment. In FIG. 2, the blocks 10, 20 and 30 are the same those in FIG. 1. A bandwidth determining circuit 80 determines boundary frequencies between the divided bandwidths according to the spectrum envelope of the input speech. In this embodiment, the number of divided bandwidths is two and the boundary frequencies are determined by detecting the minimum point of the spectrum envelope.

The bandwidth determining circuit 80 calculates autocorrelation coefficients of the twelfth order by Fourier-cosine transforming the power spectrum.

The spectrum envelope may be determined according to the following Equation (1) through LPC analysis of α parameters up to the twelfth order:

$$P(w) = \frac{S}{\sum_{j=0}^{N-1} A_j \cos(jw)} \tag{1}$$

where $$A_O = \sum_{i=0}^{N} \alpha_i^2 \tag{2}$$

$$Aj = 2\sum_{i=O}^{N=j} \alpha_i \alpha_{i+j}$$

where $\alpha_i$ are the α parameters, $\alpha_0=1$, S represents constant, w is the angular frequency (4 kHz being set at π), P(w) is the spectrum envelope at an angular frequency w and N is an order of a linear predictive coefficient, i.e., 12.

w corresponding to the minimum and maximum points of the spectrum envelope will be calculated by Equation (3) through a zero point search method:

$$-\sum_{j=1}^{N-1} j A_j \sin jw = 0 \tag{3}$$

By substituting the obtained angular frequencies ($w_1 w_2, \ldots w_M$) into Equation (4), $w_q$ corresponding to the minimum point of the spectrum envelope is developed as $w_q$ (q=1, 2, . . . , M) when $P'(w_q)$ becomes negative.

$$P'(w_q) = -\sum_{j=1}^{N-1} j^2 Aj \cos jw \tag{4}$$

The bandwidth boundary frequency $\theta_B$ may be selected through Equation (5) on the basis of the angular frequency $\theta_r$ corresponding to the minimum point of the spectrum envelope and the condition L<M:

$$\theta_B = \min\{|\theta_r - \theta_s|\} \tag{5}$$

where θs is a reference bandwidth boundary frequency ($\theta_s$ being set at 0.352π (1300 Hz). It is preferable that $\theta_s$ be set at the central point of the angular frequency distribution corresponding to the minimum point of the spectrum envelope.

The bandwidth determining circuit 80 supplies $\theta_B$ to autocorrelation calculators 41(1)–41(I) and a formant determining circuit 71.

The autocorrelation calculators 41(1)–41(I) calculate autocorrelation coefficients for each bandwidth by using the power spectrum from the power spectrum calculator 30 with the bandwidth boundary frequency of $\theta_B$ and limitation of the power spectrum frequency range through formant-cosine transformation. In this embodiment, the autocorrelation calculators 41(1)–41(I) respectively, calculate autocorrelation coefficients of sixth order by using the angular frequency of 0.0375 between $\pi \cong \theta_B$ and $\theta B \cong 0.775\pi$. The obtained autocorrelation coefficients are transferred into α parameters by LPC analyzers 51(1)–51(I).

As stated above, the frequency bandwidth to be utilized in the autocorrelation calculators 41(1)–41(I) is divided by $\theta_B$ corresponding to the minimum point of the spectrum envelope. Therefore, according to the technique there can be eliminated the shortcoming of the conventional method which fixes the boundary frequency.

The order of the α parameters from the LPC analyzers 51(1)–51(I) is reduced from N (for no divided bandwidth, i.e., only one bandwidth) to N/I where the bandwidth is divided into I bandwidths.

Equation solvers 61(1)–61(I) develop three pairs of complex conjugate solutions by using the α parameter through the numerical calculation method. Pole calculator 90(1)–90(I) determines the pole frequency and the its bandwidth from the complex conjugate solution through a well-known method later described and is detailed in a book entitled "The Basis of Speech Information Processing" by Shuzo Saito and Kazuo Nakada, Ohm-sha.

The obtained pole frequencies for their bandwidths:

$$0 > f_1^{(I)} < f_2^{(I)} < f_3^{(I)} < \theta_B - 0.0375\pi,\ (b_1^{(I)}, b_2^{(I)}, b_3^{(I)})$$

$$\vdots$$

$$0 < f_1^{(I)} < f_2^{(I)} < f_3^{(I)} < 0.775\pi - \theta_B,\ (b_1^{(I)}, b_2^{(I)}, b_3^{(I)})$$

are output to a formant determining circuit 71.

The formant determining circuit 71 calculates a pole frequency Fi for the whole bandwidth and its bandwidth Bi based on this frequency, bandwidth and $\theta_B$:

$$\begin{aligned} &Fi = f_i^{(I)} + 0.0375\pi\ (i = 1, 2, 3) \\ &Fi = f^{(I)i-3} + \theta_B\ (i = 4, 5, 6) \\ &Bi = b_i^{(I)}\ (i = , 2, 3) \\ &Bi = b^{(I)i-3}\ (i = 4, 5, 6) \end{aligned} \tag{6}$$

where $$0.0375\pi < f_1 < f_2 < f_3 < \theta_B < f_4 < f_5 < f_6 < 0.325\pi \tag{7}$$

Formant determining circuit 71 selects and outputs formant data on the basis of the pole frequency and its bandwidth obtained by using equation (6).

Figure 3:
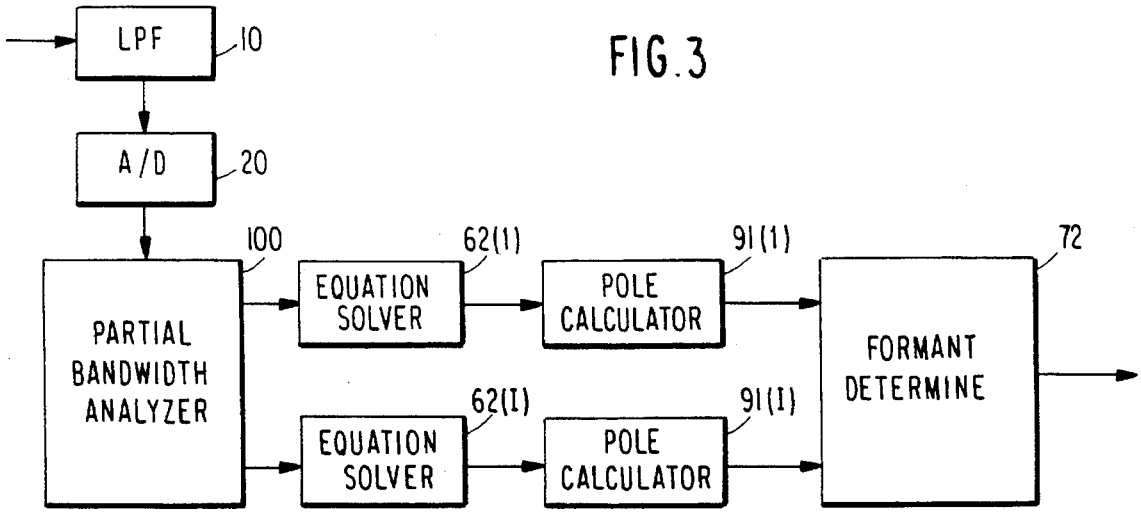
FIG. 3 shows a block diagram of the third embodiment according to the present invention.

FIG. 3 shows another embodiment of the present invention. This system is comprised of LPF 10, an A/D converter 20, a divided bandwidth LPC analyzer 100, equation solvers 62(1)–62(I) and pole calculators 91(1)–91(I), and a formant determining circuit 72. The LPF 10, and A/D converter 20 have the same function as the LPF 10 and A/D converter 20 in FIGS. 1 and 2.

Figure 4:
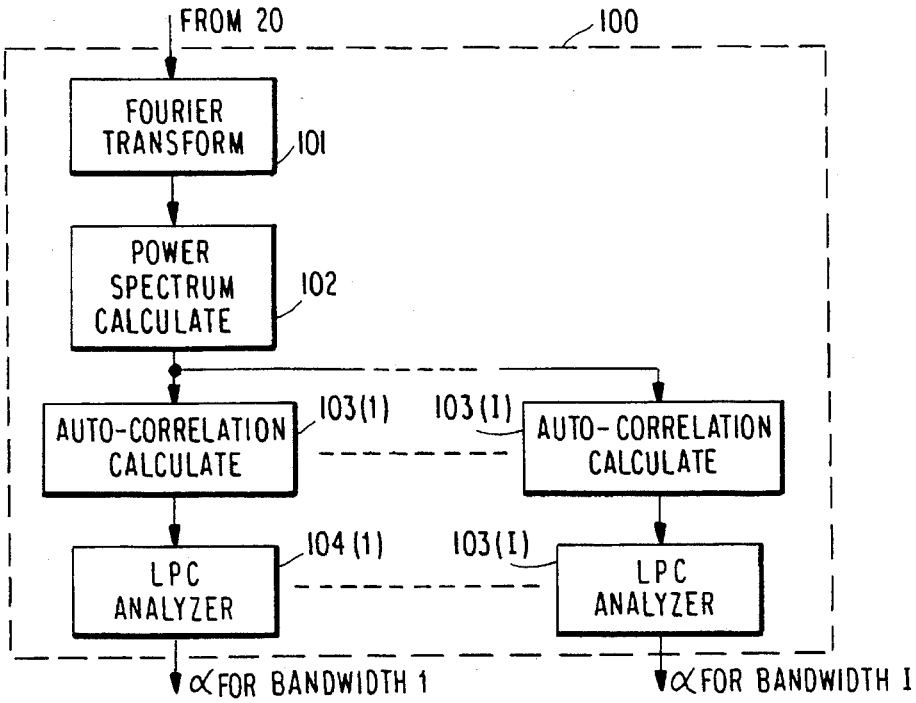
FIG. 4 shows a detailed construction of the LPC analyzer 100 shown in FIG. 3.

The divided bandwidth LPC analyzer 100, as shown in FIG. 4, includes a Fourier transform circuit 101, a power spectrum calculator 102, autocorrelation calculators 103(1)–103(I) and LPC analyzers 104(1)–104(I).

The Fourier transform circuit 101 performs a DFT (Discrete Fourier Transform) for the quantized speech signal in a basic analysis frame supplied from the A/D converter 20 and transforms this into data in a frequency domain.

The power spectrum calculator 102 calculates a power spectrum by squaring and adding calculation of the real data and imaginary data of the respective frequency components fed from the Fourier transformer 101 and stores them into a memory equipped therein.

The autocorrelation calculators 103(1)–103(I) read out the power spectrum stored in the power spectrum calculator 102 for each divided frequency bandwidth and perform IDFT (Inverse DFT) for these read out data. Since the power spectrum is a scalar quantity, this IDFT process is performed only for the real data of the cosine coefficient. The IDFT is carried out for each frequency bandwidth so that the phase difference of the cosine coefficient of each frequency component becomes zero at the lower end of each bandwidth. In this embodiment, the respective frequency bandwidths of the autocorrelation calculators 103(1)–103(I) are expanded or widened in order to eliminate the problem caused where a formant frequency exists at the divided point (boundary point) of the bandwidth.

Figure 5:
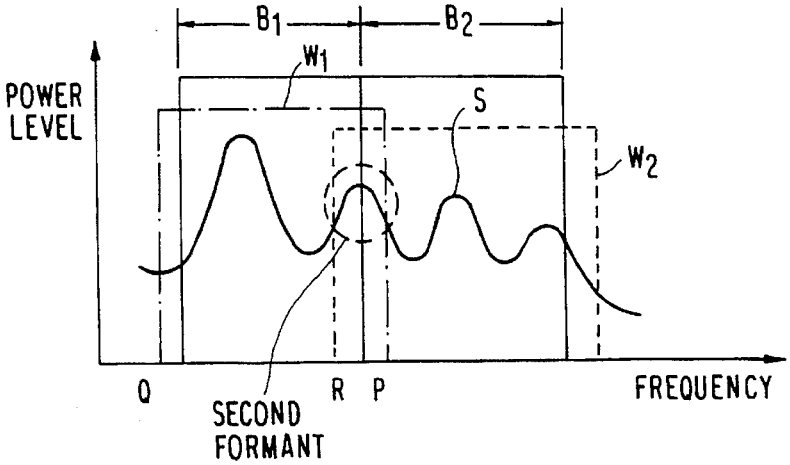
FIG. 5 shows a drawing of spectrum distribution for explaining the third embodiment.

FIG. 5 shows a diagram for explaining the bandwidth division according to this embodiment. This embodiment employs two divisions of the bandwidth, however, other number of divisions is also employable.

In FIG. 5, S indicates the spectrum envelope of the input speech. The conventional formant extractor extracts formant information by using LPC coefficients extracted for the respective non-overlapping bandwidths $B_1$ and $B_2$ as shown in solid line. The frequency range of the bandwidths $B_1$ and $B_2$ is set at the narrowest range (for example 281.25~3218.25 Hz) which covers a distribution range of the first through third formants, but not a range of extra frequency components. The boundary frequency P is set at, for example, 1250 Hz, so that the respective divided ranges (bandwidths) include at least one formant frequency. It will be apparent in FIG. 5 that, when a formant, e.g., the second formant, exists at the divided bandwidth point P, the second formant cannot be estimated for both bandwidths $B_1$ and $B_2$.

This invention expands or widens the frequency bandwidth, i.e., the bandwidth $B_1$ is widened to $w_1$ and $B_2$ is widened to $w_2$ as shown in dotted lines. In other words, the bandwidth is widened to include or cover the original frequency bandwidth for formant frequency. Therefore, the second formant is completely included in the widened frequency bandwidth $w_1$ thereby eliminating the shortcoming of the conventional technique. The degree of widening of the bandwidth is easily predetermined based on the many speech samples and experiences, and considering formant extraction accuracy and calculation quantity. The overlapped bandwidth may cover the bandwidth of a pole frequency which represents any one of a plurality of formants, i.e., 30–200 Hz. Preferably, such a bandwidth lies between 60–70 Hz. Most favorable results have been obtained with the overlapped bandwidth of 62.5 Hz.

As is apparent from the foregoing, the phases of frequencies at points Q and R in the first divided bandwidth $W_1$ and the second divided frequency bandwidth $W_2$ show respective reference phase points where the phase angle of the cosine coefficient is zero.

The autocorrelation calculators 103(1)–103(I) perform the foregoing IDFT processing for the data in the bandwidth to derive autocorrelation coefficients. The LPC analyzers 104(1)–104(I) then extract α parameters, of an order corresponding to that of the autocorrelation coefficient as LPC coefficients. The equation solvers 62(1)–62(I) and the pole calculators 91(1)–91(I) have the same operation functions as the equation solvers 61(1)–61(I) and the pole calculators 90(1)–90(I) in FIG. 2. Through these means, the pole frequencies and its bandwidth are derived.

Formant determining circuit 72 determines formant information included in those pole frequencies by using the pole frequencies and their bandwidths through well-known methods. It should be noted here that this formant determination is performed for the divided bandwidths without any overlap between the bandwidths as shown by $B_1$ and $B_2$ in FIG. 5. This is clearly understood from the object of the processing which intends to extract formant information exactly. The concept of the third embodiment can be applied to the second embodiment by controlling the superimposed portion of the subsequent and preceding bandwidths based on the envelope of the speech signal.

The method for determining the pole central frequency and its bandwidth from LPC coefficients will now be described.

A transmission function $H(Z)^{-1}$ of a pole-type digital filter used as a speech synthesizer on the synthesis side is expressed by $$H(Z)^{-1}=1/A_p(Z)^{-1}$$

where $A_p(Z)^{-1}=1+\alpha_1 Z^{-1}+\alpha_2 Z^{-2}+\ldots+\alpha_p Z^{-p}$ $Z=\exp(j\lambda)$ $\lambda=Z\pi Tf$ $\Delta T$=sampling period f=frequency p=order of the digital filter $\alpha_1\sim\alpha_p=\alpha$parameters as LPC coefficients of P order.

In order to develop the pole, the root of $A_1(Z^{-1})=0$ is determined ($A_p(Z^{-1})$ for P=6) as shown in Equation (7). As a result of bandwidth division, the root development for the high order equation is simplified, such as reduction in order from 12 to 6:

$$1+\alpha_1 Z^{-1}+\alpha_2 Z^{-2}+\alpha_3 Z^{-3}+\alpha_4 Z^{-4}+\alpha_5 Z^{-5}+\alpha_6 Z^{-6}=0 \quad (7)$$

Equation (7) can be changed to Equation (8):

$$\alpha_6+\alpha_5 Z+\alpha_4 Z^2+\alpha_3 Z^3+\alpha_2 Z^4+\alpha Z^5+Z^6=0 \quad (8)$$

Equation (8) can be expressed by a combination of second order equations with three Z terms shown by Equation (9).

$$(Z^2+A_1Z+b_1)(Z^2+A_2Z+b_2)\times(Z^2+A_3Z+b_3)=0 \quad (9)$$

where $A_1\sim A_3$, $b_1\sim b_3$ are real coefficients of α, for instance $b_1\cdot b_2\cdot b_3=\alpha_6$. Each second order equation of Equation (9) has a pair of complex conjugate solutions which specify three poles.

A second order equation of Z having real coefficients α is shown as $Z^2+\alpha_1 Z+\alpha_2$. A pair of complex conjugate solutions of the second order equation is expressed by Equation (10)

$$Z=\frac{1}{2\alpha_2}\left(\alpha_1\pm\sqrt{4\alpha_2-(\alpha_1)_j^z}\right) \quad (10)$$

Generally, it is easy to develop a pair of Z through a numerical calculation method. Thus, if a pair of complex conjugate solutions is determined, Equation (9) is shown as a fourth-order equation of a combination of two second-order equations and the rest of pair of complex conjugate solutions are also easily obtainable through numerical calculation or arithmetic calculation.

The method for developing the pole frequency and its bandwidth from the complex conjugate solutions, which is well known as said before, will now be described briefly.

The complex conjugate solutions Z, $\bar{Z}$ are expressed by Equation (11)

$$Z=e^{jo}$$

$$\bar{Z}=e^{-jo} \quad (11)$$

Z can also be shown by Equation (12) on the complex plane.

$$Z=e^{ST}=e^{(-p+jw)T}=e^{-PT}e^{jwT}=re^{j\phi} \quad (12)$$

Accordingly, the pole frequencies and their bandwidths corresponding to three pairs of complex conjugate solutions can be obtained for lower and higher bandwidths.

I claim:

1. A formant extractor comprising:

first means for receiving an electrical signal representing a speech signal having a predetermined frequency bandwidth, said predetermined frequency bandwidth comprising a low frequency bandwidth and a high frequency bandwidth;

power spectrum calculating means for determining a power spectrum for said predetermined frequency bandwidth;

autocorrelation calculating means, responsive to an output of said power spectrum calculating means, for calculating first autocorrelation information for said low frequency bandwidth and second autocorrelation information for said high frequency bandwidth;

LPC (Linear Predictive coding) determining means, responsive to said first autocorrelation information and said second autocorrelation information, for determining first LPC information and second LPC information, respectively;

pole frequency determining means,.responsive to said first LPC information and said second LPC information, for determining a first set of pole frequencies and corresponding pole frequency bandwidths and a second set of pole frequencies and corresponding pole frequency bandwidths, respectively;

bandwidth determining means, responsive to said power spectrum developed by said power spectrum calculating means, for determining a boundary frequency between said low frequency bandwidth and said high frequency bandwidth; and formant determining means for determining formant data based upon said first set of pole frequencies, said second set of pole frequencies and said boundary frequency.

2. The formant extractor as claimed in claim 1, wherein said bandwidth determining means determines said boundary frequency based upon a minimum point of a spectrum envelope of said speech signal.

3. The formant extractor as claimed in claim 2, wherein said low frequency bandwidth and said high frequency bandwidth overlap to produce an overlapped frequency range.

* * * * *

UNITED STATES PATENT AND TRADEMARK OFFICE
CERTIFICATE OF CORRECTION

PATENT NO. : 5,463,716
DATED : October 31, 1995
INVENTOR(S) : Tetsu TAGUCHI

It is certified that error(s) appears in the above-identified patent and that said Letters Patent is hereby corrected as shown below:

Abstract, line 3, delete "LPC" and insert --linear predictive coding (LPC)--.

Col. 4, line 41, after "(i= " insert --1--.

Signed and Sealed this

Twentieth Day of August, 1996

Bruce Lehman

*Attest:*

BRUCE LEHMAN

*Attesting Officer*

*Commissioner of Patents and Trademarks*